United States Patent [19]

Gold et al.

[11] Patent Number: 4,997,396

[45] Date of Patent: Mar. 5, 1991

[54] WEATHERPROOF VEHICLE REAR WINDOW DEFROSTER ELECTRICAL CONNECTION

[76] Inventors: Peter Gold; Meredith Gold, both of 465 N. Wood Rd., Rockville Centre, N.Y. 11570

[21] Appl. No.: 468,020

[22] Filed: Jan. 22, 1990

[51] Int. Cl.[5] ..... H01R 4/38

[52] U.S. Cl. ..... 439/801; 219/203; 219/547

[58] Field of Search ..... 219/203, 547, 541, 522; 439/34, 801, 815

[56] References Cited

U.S. PATENT DOCUMENTS

| | | | |
|---|---|---|---|
| 3,794,953 | 2/1974 | Malin | 439/801 X |
| 4,213,028 | 7/1980 | Wolf | 219/541 X |
| 4,297,565 | 10/1981 | Parr | 219/541 X |

*Primary Examiner*—Eugene F. Desmond

[57] ABSTRACT

A vehicle, preferably "hatchback", rear window defroster electrical connector using an adhesively secured threaded post to receive thereon a circular electrical element which is pressed into an electrical connection by a nut against the defroster conductive deposit on the rear window, thereby avoiding the use of solder which deteriorates upon exposure to weather elements occasioned by the frequent opening of the hatchback rear window door or panel.

4 Claims, 1 Drawing Sheet

WEATHERPROOF VEHICLE REAR WINDOW DEFROSTER ELECTRICAL CONNECTION

The present invention relates generally to a vehicle rear window defroster electrical connection that will not "short circuit" upon exposure to weather elements or otherwise malfunction, and more particularly to a solderless electrical connection of the type noted which, it has been determined by obviating the use of this material (now in almost universal use for vehicle rear window defroster electrical connections) results in a weatherproof connection of a more reliable and efficient nature.

EXAMPLES OF THE PRIOR ART

The within inventive vehicle rear window defroster electrical connection is intended to replace the so-called pigtail connector currently in use. Underlying the present invention is the recognition that the weather elements, i.e. snow and rain, adversely affect the solder connecting the pigtail holder to the silver oxide bus bar of the rear window defroster, particularly in a hatchback vehicle which has the defroster on a rear panel which is opened and closed, and causes "hot spots" which eventually destroys the electrical connection and might even result in rupture of the rear window glass.

For example, in Karla, U.S. Pat. No. 4,618,088 issued on Oct. 21, 1986, which is typical of presently used car window defroster circuits, the current connecting element 14 is soldered, as at 20, to the current feed conductor 3, so that deterioration of the solder 20 as will occur due to exposure to weather conditions, will result in a "short circuit".

Likewise, in Wallace, U.S. Pat. No. 2,984,816 issued on May 16, 1961, the electrical connection between the conductors 13 with the defroster heater wires 14 is made by pressing the two together in an electrical connection. Also, the conductors 13 are soldered, as at 47 and 48 and mentioned in col. 4 in lines 11–14, to achieve electrical continuity, and this solder, again due to exposure to the weather, is vulnerable to deterioration.

Broadly, it is an object of the present invention to provide a vehicle rear window defroster electrical connection overcoming the foregoing and other shortcomings of the prior art. More specifically, it is an object to provide an electrical connection between a vehicle battery source and the defroster silver oxide bus bar without the use of solder, while nevertheless achieving electrical continuity therebetween, to thereby provide, by obviating the solder, an improved weatherproof electrical connection, all as will be explained in greater detail subsequently.

The description of the invention which follows, together with the accompanying drawings should not be construed as limiting the invention to the example shown and described, because those skilled in the art to which this invention appertains will be able to devise other forms thereof within the ambit of the appended claims.

Figure 1:
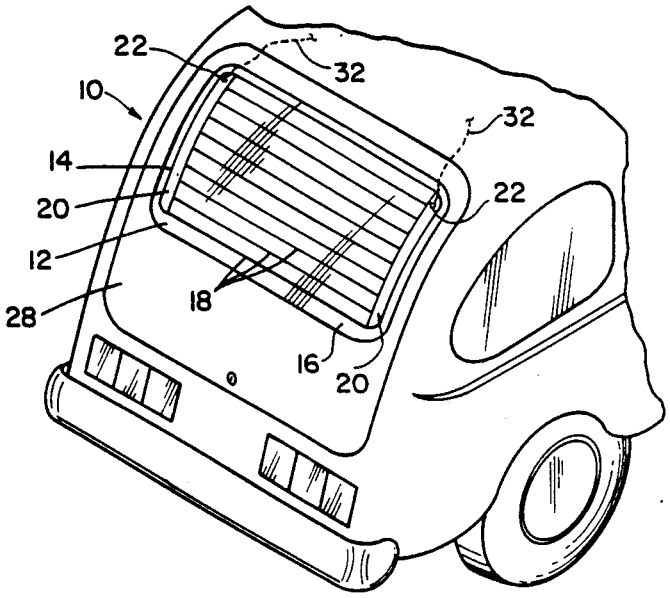
FIG.1 PRIOR ART
FIG. 1 is a perspective view of the rear panel of a so-called hatchback vehicle having a rear window defroster.

Referring to FIG. 1, there is shown the rear portion of a known type so-called hatchback vehicle 10 having a rear window panel 12 which in a known manner is electrically arranged to be heated for defrosting purposes by an imprinted resistance pattern 14. Pattern 14 is typically made of a conductive metal silver oxide fused or otherwise sealed to the interior face of glass 16, and consists of uniformly spaced parallel lines 18 which terminate in a peripheral so-called bus bar 20. When a low voltage is applied from the vehicle battery to bus bar 20, a current flows through each of the lines 18 generating enough heat to warm glass 16 in a well known manner to defrost it of ice, snow or fog. Each bus bar 20 is connected to the powering vehicle battery (not shown) through a terminal 22 (FIG. 1), known as a pigtail connector.

The just-described window heating or defroster system 14 can be used on many type vehicles including automobiles, trucks, air and sea craft. Terminals 22 are not normally subject to ambient temperature extremes, vibrations, weathering and age deterioration. When system 14 is used, however, in a hatchback auto as intended to be depicted in FIG. 1, each terminal 22 has to endure the additional stress due to hinge action as hatch door 28 is repeatedly opened and closed and, in the open condition, is also subject to the weather elements of snow and rain.

Figure 2:
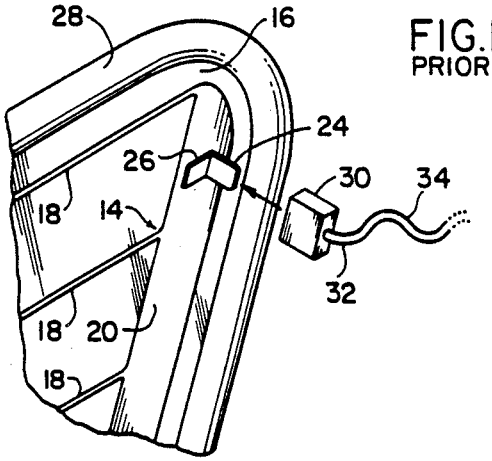
FIG.2 PRIOR ART
FIG. 2 is a perspective view, as seen from within the vehicle, of a typical prior art electrical connection from the battery source to the rear window defroster.

In the prior art structure of FIG. 2, a comparable prior art terminal 22 is shown to consist of a bracket-like prong 24 that has one leg soldered, at 26 to bus 20, the particular use of solder, which is electrically conductive, being almost universally used in order to provide a corresponding electrically conductive connection from the vehicle battery to the bus 20.

Prong 24 is further designed to frictionally fit within an electric socket 30 which is typically connected to a flexible cable 32 which, after a slack length 34, is threaded into the body of vehicle 10 in the vicinity of the hinge (not shown) of the hatch door 28. When the window warming or defroster system 14 fails to operate, it has been a significant determination underlying the present invention that frequently the malfunction is because the solder connection 26 between prong 24 and bus 20 has "opened" electrically, due to exposure to the weather, and also to the stress of the rear panel or hatch door 28 opening and closing.

Figure 3:
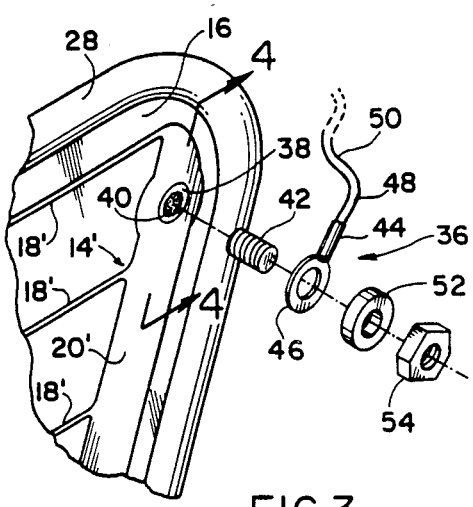
FIG. 3 is a perspective view made similar to FIG. 2 for comparison purposes, but illustrating the within inventive defroster electrical connection.
Figure 4:
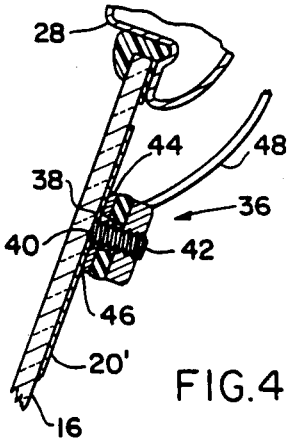
FIG. 4 is a sectional view as taken along line 4—4 of FIG. 3, showing further structural details.

The improvements of the present invention are shown in FIGS. 3 and 4, where a cooperating pair of components constitute each terminal assembly 36 in replacement of the prior art terminals 22. Defroster system 14, imprinted with silver oxide on glass 16, has parallel heating lines 18 that terminate in buses 20. Each bus 20 has a removed circular area providing an open or bare spot 38 functioning as an attachment location, where adhesive 40, of any known type that is resistant to the weather, is applied directly to the surface of the glass 16. One suitable type adhesive 50 is Loctite Minute Bond 312 made by Loctite Corp. of Newington, Conn. A threaded non-electrically conductive phenolic stud 42 is adhesively secured in place as a result of contact with adhesive 40 within the attachment location opening 38. After adhesive 40 has cured, a connector component 46 bounding a cable eyelet opening is slipped over stud 42 and Pressed into electrically conductive contact with the silver oxide of bus 20 surrounding the attachment location 40 by a rubber washer 52 and nut 54. To this end, the diameter of the circular electrically conductive component 46 is sized to overlap said silver oxide bounding the location 40. Eyelet 44 has a flexible cable 48 connected to it which has a slack length 50 and threads into the body of vehicle 10 as did cable 32. In use, rubber washer 52 dampens mechanical vibrations in addition to serving as a lock washer.

While the particular vehicle rear window defroster electrical connector herein shown and disclosed in detail is fully capable of attaining the objectives and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. An improved solderless electrical connection for a vehicle rear window defroster comprising an electrically conductive coating for a vehicle rear window defroster applied to an internal surface of a vehicle rear window, a removed area from said electrically conductive coating exposing said vehicle rear window surface so as to delineate an attachment location for a battery connection to said electrically conductive coating, an adhesive deposit on said exposed vehicle rear window surface in said delineated attachment location, a threaded connection member disposed on said adhesive deposit and adhesively secured to said vehicle rear window surface, a rear window defroster electrical connector bounding a circular opening having an operative position disposed in encircling relation about said adhesively secured threaded connection member, and a nut in threaded engagement with said threaded connection member in superposed relation above said defroster electrical connector, whereby without said solder an electrical energizing circuit for said rear window defroster is completed by threaded adjustment of said nut so as to press said defroster electrical connector against said electrically conductive coating surrounding said threaded connection member.

2. The improved electrical connection for a vehicle rear window defroster as claimed in claim 1, including an elastomeric washer in interposed position between said defroster electrical connector and said nut.

3. An improved weatherproof defroster electrical connection for a vehicle rear window on a panel of the type hingedly mounted along its upper edge for pivotal movement out of a vehicle rear panel opening thereby exposing in such open position said rear window defroster to prevailing weather conditions, said defroster electrical connection comprising an electrically conductive coating applied to an internal surface of said vehicle rear window, a removed area from said electrically conductive coating exposing said vehicle rear window surface so as to delineate an attachment location for a battery connection to said electrically conductive coating, a threaded connection member adhesively secured at said attachment location to said vehicle rear window surface, a rear window defroster electrical connector bounding a circular opening having an operative position mounted on said threaded connection member with said threaded connection member projected through said circular opening thereof, and a nut in superposed relation above said defroster electrical connector in threaded engagement with said threaded connection member, whereby without any solder as might be adversely affected by weather conditions an electrical energizing circuit for said rear window defroster is completed by threaded adjustment of said nut so as to press said defroster electrical connector against said electrically conductive coating surrounding said threaded connection member.

4. The improved electrical connection for a vehicle rear window defroster as claimed in claim 3, including an elastomeric washer in interposed position between said defroster electrical connector and said nut.

* * * * *